US006969150B2

(12) United States Patent
Foote et al.

(10) Patent No.: US 6,969,150 B2
(45) **Date of Patent: *Nov. 29, 2005**

(54) MODULAR PAGEWIDTH PRINTHEAD HAVING REPLACEABLE PRINTHEAD MODULES

(75) Inventors: Roger Mervyn Lloyd Foote, Balmain (AU); Tobin Allen King, Balmain (AU); Garry Raymond Jackson, Balmain (AU); Kia Silverbrook, Balmain (AU)

(73) Assignee: Silverbrook Research PTY LTD, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/659,021

(22) Filed: Sep. 11, 2003

(65) Prior Publication Data

US 2004/0046834 A1 Mar. 11, 2004

Related U.S. Application Data

(63) Continuation of application No. 09/693,644, filed on Oct. 20, 2000, now Pat. No. 6,655,786.

(51) Int. Cl.[7] ..... B41J 2/155
(52) U.S. Cl. ..... 347/49; 347/42
(58) Field of Search ..... 347/49, 42, 85, 347/86

(56) References Cited

U.S. PATENT DOCUMENTS

| | | | |
|---|---|---|---|
| 5,148,194 | A | 9/1992 | Asai et al. |
| 5,245,361 | A | 9/1993 | Kashimura et al. |
| 5,565,900 | A | 10/1996 | Cowger et al. |
| 5,969,730 | A | 10/1999 | Inose et al. |
| 6,655,786 | B1 | 12/2003 | Foote et al. |

FOREIGN PATENT DOCUMENTS

| | | |
|---|---|---|
| DE | 4031192 | 4/1992 |
| EP | 1043158 | 10/2000 |
| JP | 7214820 | 8/1995 |

*Primary Examiner*—K. Feggins
*Assistant Examiner*—Julian D. Huffman

(57) ABSTRACT

A printhead for a pagewidth ink jet printer comprises an elongate receiving member that defines a receptacle and at least one elongate printhead module. Each of the printhead modules defines a channel in which a printhead chip is receivable. The the receiving member and the printhead modules together define pairs of complementary location formations such that the printhead module is received in the receptacle so that the complementary locating formations engage each other. The modules extend along a longitudinal axis of the receiving member. The complementary location formations comprise a projection and a recess adapted to receive the projection. The projection is slidably received within the recess so that expansion of the printhead module relative to the receiving member along the longitudinal axis is accommodated.

14 Claims, 11 Drawing Sheets

MODULAR PAGEWIDTH PRINTHEAD HAVING REPLACEABLE PRINTHEAD MODULES

CROSS REFERENCE TO RELATED APPLICATIONS

This is a continuation application of U.S. Application Ser. No. 09/693,644 filed on Oct. 20, 2000 now issued U.S. Pat. No. 6,655,786, all of which are herein incorporated by reference.

FIELD OF THE INVENTION

This invention relates to a modular printhead. More particularly, the invention relates to the assembly of such a modular printhead. Specifically, this invention relates to a mounting of a printhead in a support member of a modular printhead.

BACKGROUND TO THE INVENTION

The applicant has previously proposed the use of a pagewidth printhead to provide photographic quality printing. However, manufacturing such a pagewidth printhead having the required dimensions is problematic in the sense that, if any nozzle of the printhead is defective, the entire printhead needs to be scrapped and replaced.

Accordingly, the applicant has proposed the use of a pagewidth printhead made up of a plurality of small, replaceable printhead modules which are arranged in end-to-end relationship. The advantage of this arrangement is the ability to remove and replace any defective module in a pagewidth printhead without having to scrap the entire printhead.

It is also necessary to accommodate thermal expansion of the individual modules in the assembly constituting the pagewidth printhead to ensure that adjacent modules maintain their required alignment with each other.

SUMMARY OF THE INVENTION

In accordance with the invention, there is provided a printhead for a pagewidth ink jet printer, the printhead comprising:

an elongate receiving member that defines a receptacle; and at least one elongate printhead module, the, or each printhead module defining a channel in which a printhead chip is receivable, the receiving member and the, or each printhead module, together defining pairs of complementary location formations such that the, or each printhead module is received in the receptacle so that the complementary locating formations engage each other, with the, or each, module extending along a longitudinal axis of the receiving member, wherein, for the, or each printhead module, the complementary location formations comprise a first pair of complementary location formations, the first pair comprising a projection and a recess adapted to receive the projection, wherein the recess is extended in the longitudinal direction with respect to the projection and wherein the projection is slidably received within the recess so that expansion of the, or each, printhead module relative to the receiving member along the longitudinal axis is accommodated.

Preferably, the receiving member has opposed walls interconnected by a bridging portion to define the receptacle.

More preferably, the printhead includes a plurality of printhead modules arranged in end-to-end relationship in the receptacle, each channel being angled with respect to its associated module so that the printhead chips of adjacent modules overlap. It is particularly preferred that each module is stepped at its end to nest with a consecutive module.

In an alternative embodiment, each printhead module has a set of locating formations and the receiving member has a complementary set of locating formations at a location for each module in the receptacle.

Preferably, the recess is a slot, and the projection is hemispherical.

In a preferred embodiment, for the or each printhead module, the complementary location formations further comprises a second pair of complementary location formations comprising a projection and a correspondingly sized recess for receiving the projection to locate the, or each printhead module in a longitudinal direction within the receiving member. Preferably, the recesses of the first and second pair of complementary location formations are formed in a first wall of the, or each printhead module, and the projections of the first and second pair of complementary location formations are formed in a first wall of the receiving member. More preferably, the recesses of the first and second pair of complementary location formations are substantially triangular, when viewed in cross section normal to the longitudinal axis.

In a preferred embodiment, for the, or each, printhead module, the complementary location formations further comprises a third pair of complementary location formations comprising a projection and a recess, the third formation of the receiving member being formed in a second wall of the receiving member opposite the first wall, the third formation of the, or each printhead module being formed in a second wall of the, or each printhead module. Preferably, the third pair of complementary formations comprises a snap release extending from the second wall of the receiving member and a third recess formed in the printhead module, wherein the snap release is received in the third recess such that an inner end of the snap release abuts against a wall of the third recess. More preferably, the width of the, or each printhead module is less than a spacing between the first and second opposed walls of the receiving member, and for the, or each printhead module, the snap release urges the printhead module towards the first wall of the receiving member such that the projections of the first and second complementary location formations are received in the respective recesses of the first and second complementary location formations. Preferably the snap release is mounted on a resiliently flexible arm of the second wall of the receiving member.

In a preferred form, the length of the snap release in the longitudinal direction is shorter than the length of the recess.

BRIEF DESCRIPTION OF THE DRAWINGS

The invention is now described by way of example with reference to the accompanying drawings in which.

DETAILED DESCRIPTION OF THE DRAWINGS

Figure 1:
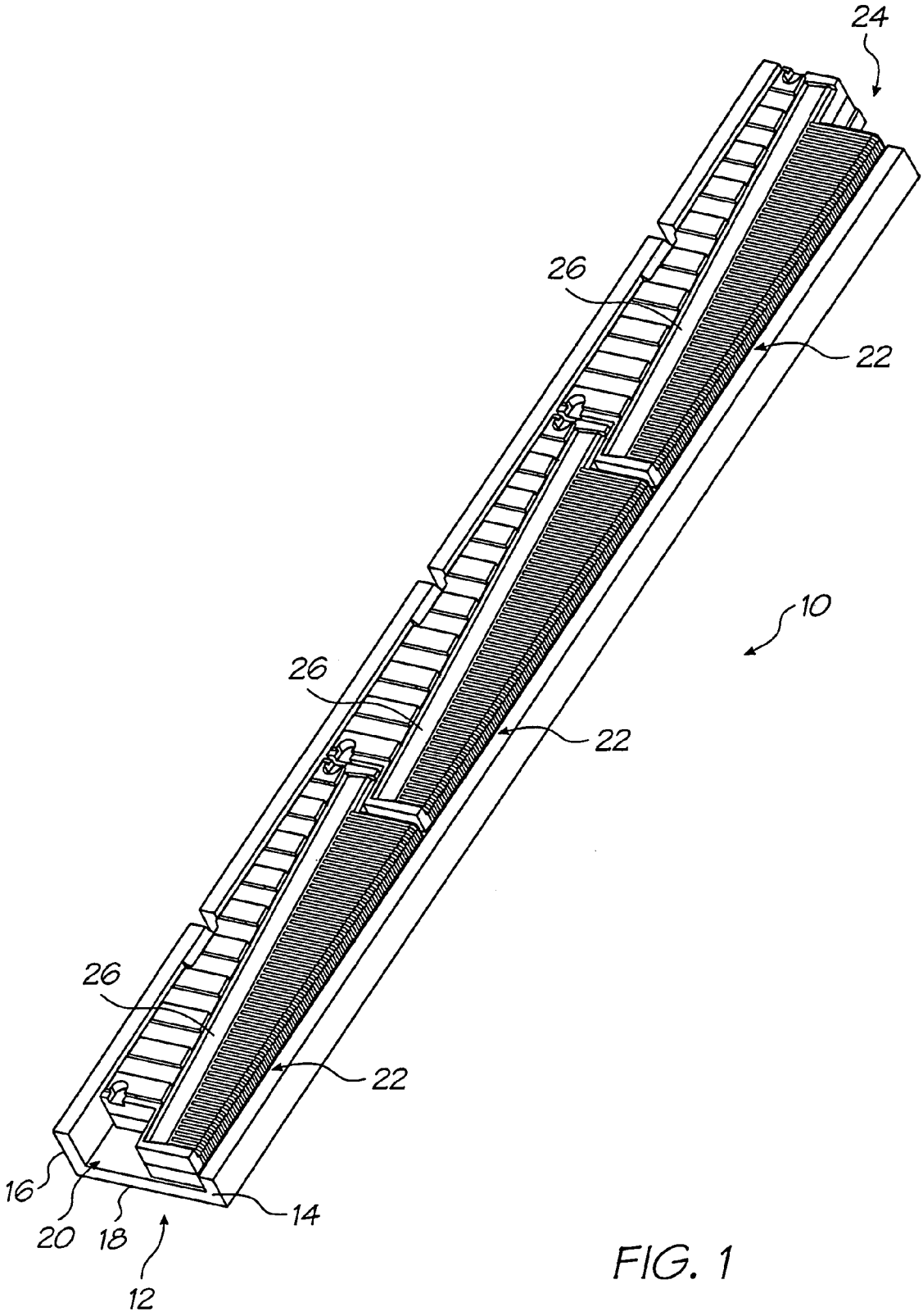
FIG. 1 shows a three dimensional view of a multi-module printhead, in accordance with the invention.
Figure 2:
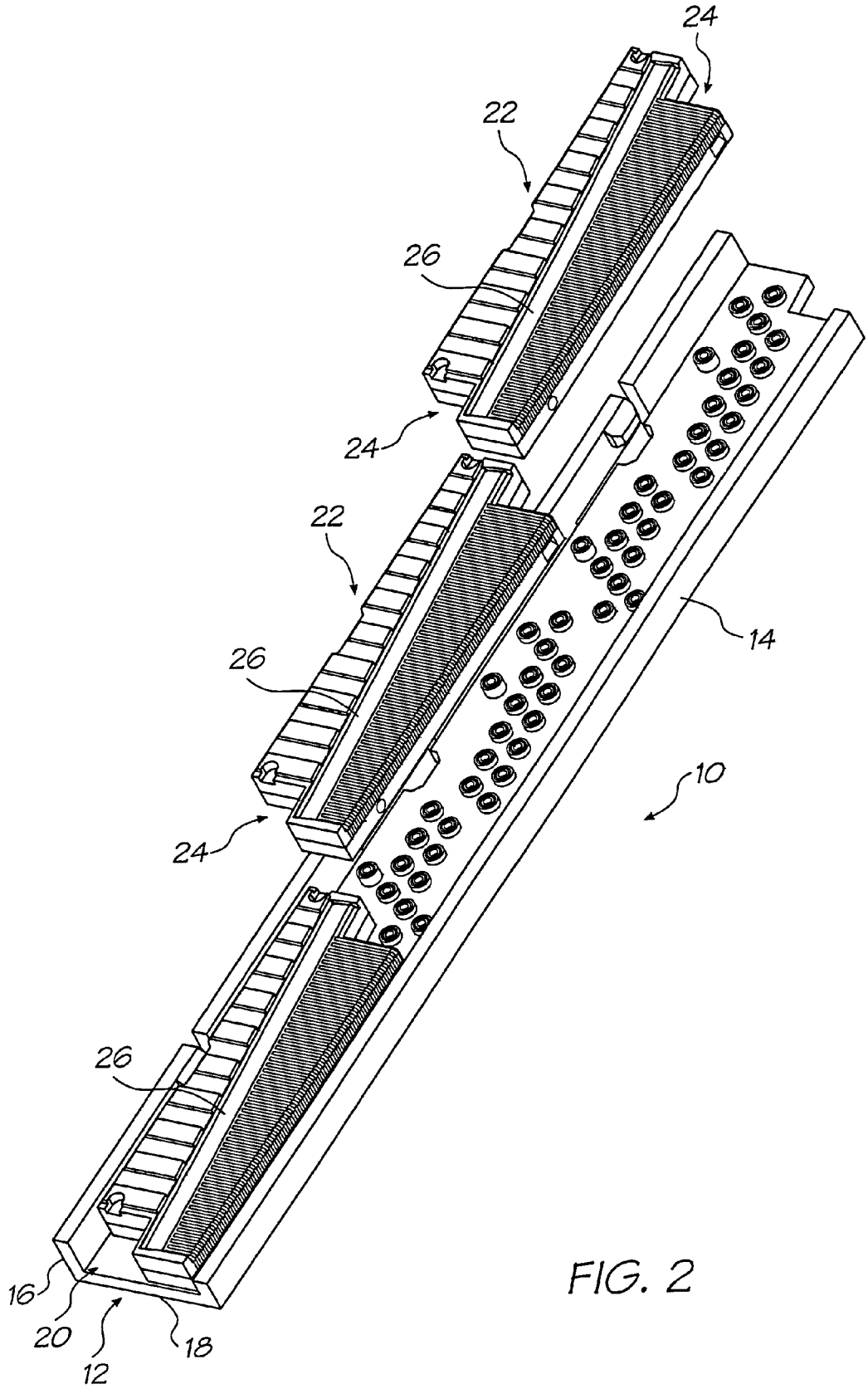
FIG. 2 shows a three dimensional, exploded view of the printhead of FIG. 1.
Figure 4:
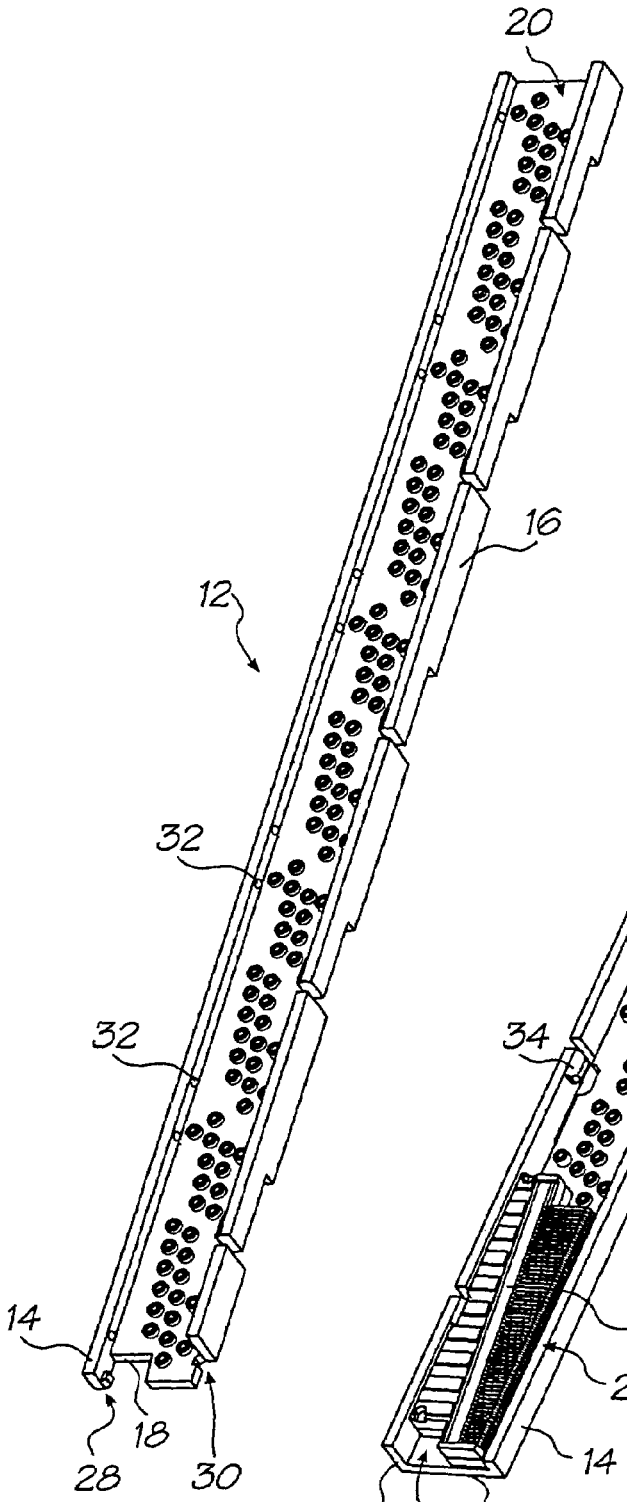
FIG. 4 shows a three dimensional view of the mounting member, from the other side.
Figure 3:
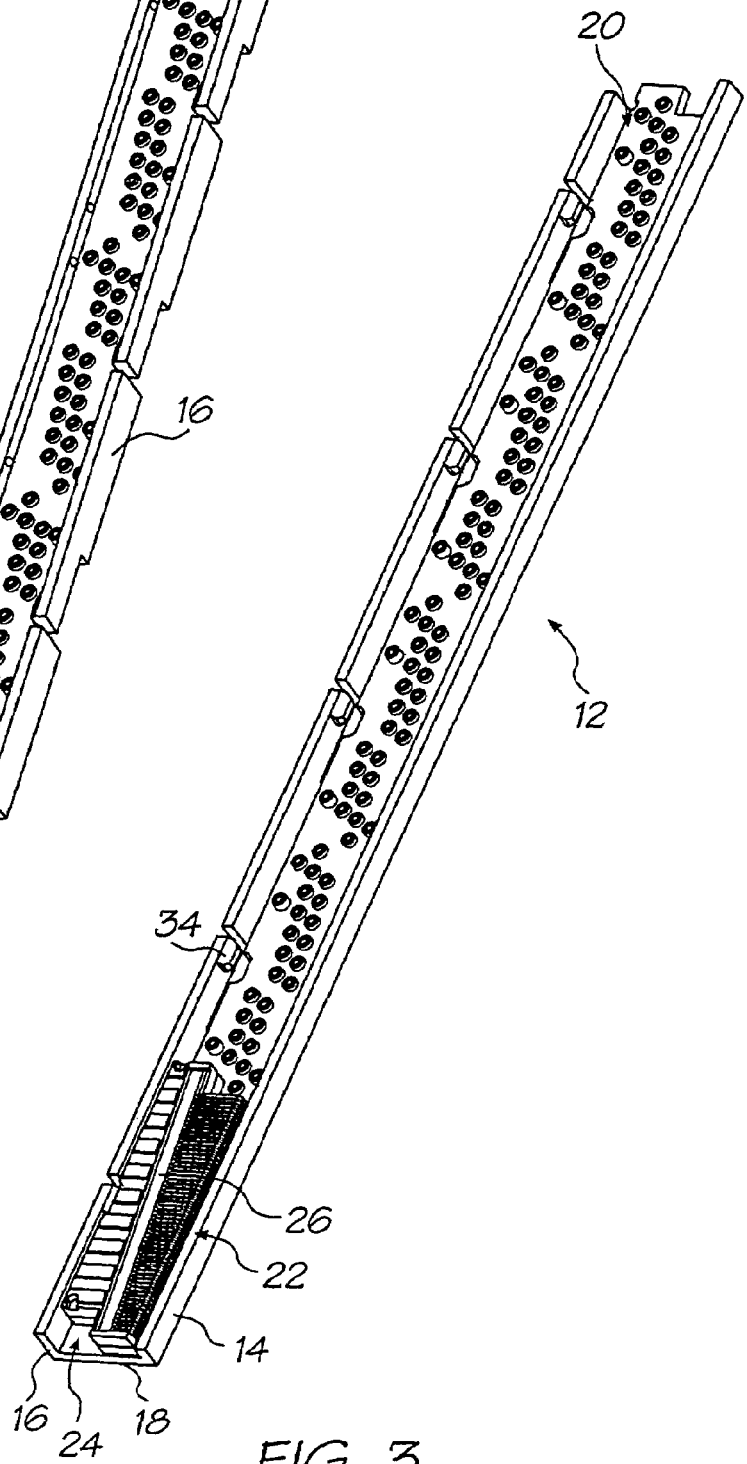
FIG. 3 shows a three dimensional view, from one side, of a mounting member of a printhead, in accordance with the invention.
Figure 5:
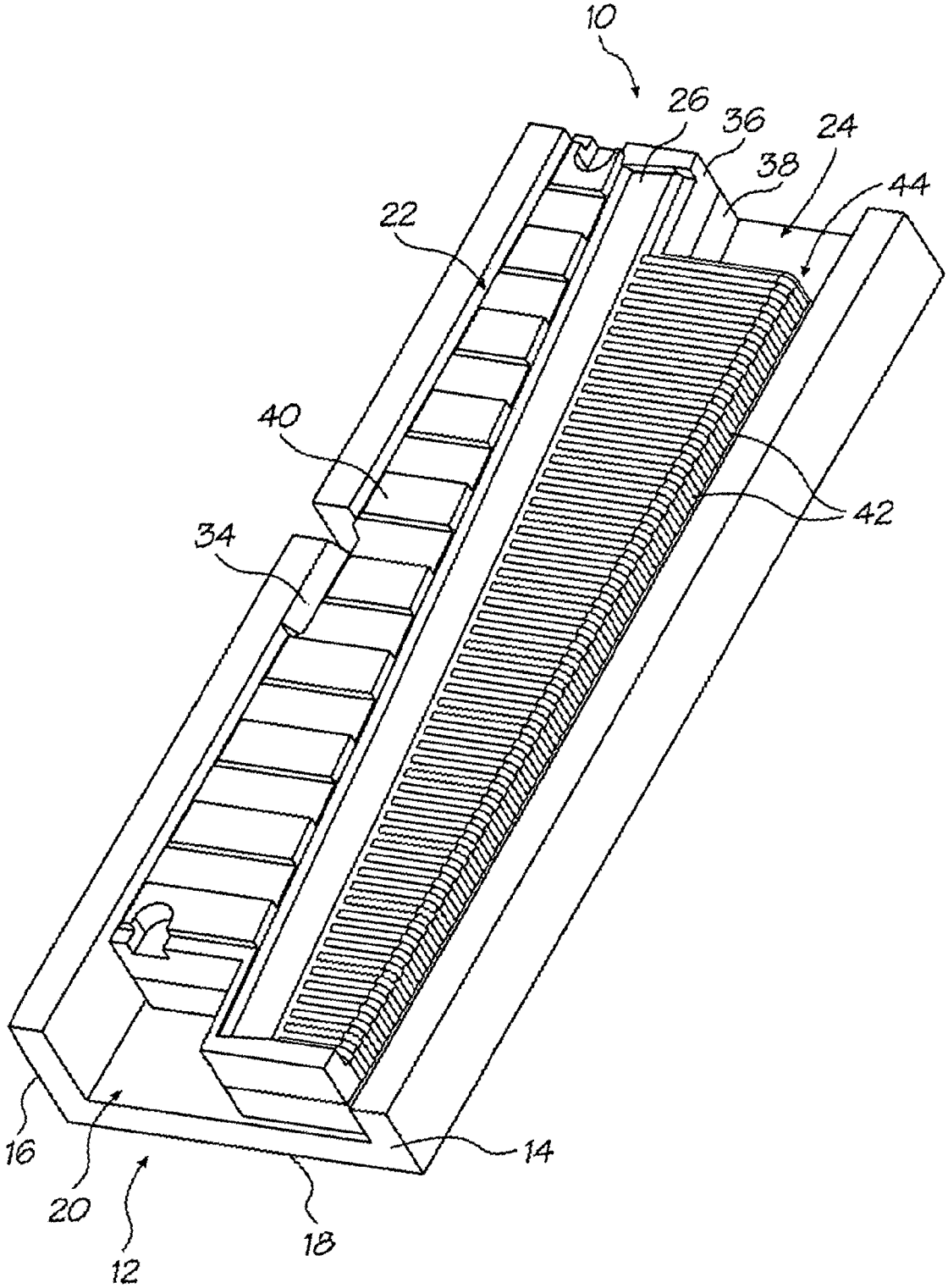
FIG. 5 shows a three dimensional view of a single module printhead, in accordance with the invention.

A printhead, in accordance with the invention, is designated generally by the reference numeral 10. The printhead 10 can either be a multi-module printhead, as shown in FIGS. 1 to 4 or a single module printhead as shown in FIGS. 5 to 15. In practice, the printhead is likely to be a multi-module printhead and the illustrated, single module printhead is provided more for explanation purposes.

The printhead 10 includes a mounting member in the form of a channel shaped member 12. The channel shaped member 12 has a pair of opposed side walls 14, 16 interconnected by a bridging portion or floor portion 18 to define a channel 20.

A plurality of printhead components in the form of modules or tiles 22 are arranged in end-to-end fashion in the channel 20 of the channel shaped member 12.

As illustrated, each tile 22 has a stepped end region 24 so that, when adjacent tiles 22 are butted together end-to-end, printhead chips 26 of the adjacent tiles 22 overlap. It is also to be noted that the printhead chip 26 extends at an angle relative to longitudinal sides of its associated tile 22 to facilitate the overlap between chips 26 of adjacent tiles 22. The angle of overlap allows the overlap area between adjacent chips 26 to fall on a common pitch between ink nozzles of the printhead chips 26. In addition, it will be appreciated that, by having the printhead chips 26 of adjacent tiles 22 overlapping, no discontinuity of printed matter appears when the matter is printed on print media (not shown) passing across the printhead 10.

If desired, a plurality of channel shaped members 12 can be arranged in end-to-end fashion to extend the length of the printhead 10. For this purpose, a clip 28 and a receiving formation 30 (FIG. 4) are arranged at one end of the channel shaped member 12 to mate and engage with corresponding formations (not shown) of an adjacent channel shaped member 12.

Those skilled in the art will appreciate that the nozzles of the printhead chip have dimensions measured in micrometers. For example, a nozzle opening of each nozzle may be about 11 or 12 micrometers. To ensure photographic quality printing, it is important that the tiles 22 of the printhead 10 are accurately aligned relative to each other and maintain that alignment under operating conditions. Under such operating conditions, elevated temperatures cause expansion of the tiles 22. It is necessary to account for this expansion while still maintaining alignment of adjacent tiles 22 relative to each other.

For this purpose, the channel shaped member 12 and each tile 22 have complementary locating formations for locating the tiles 22 in the channel 20 of the channel shaped member 12. The locating formations of the channel shaped member 12 comprise a pair of longitudinally spaced engaging or locating formations 32 arranged on an inner surface of the wall 14 of the channel shaped member 12. More particularly, each tile 22 has two such locating formations 32 associated with it. Further, the locating formations of the channel shaped member 12 include a securing means in the form of a snap release or clip 34 arranged on an inner surface of the wall 16 of the channel shaped member 12. Each tile 22 has a single snap release 34 associated with it. One of the mounting formations 32 is shown more clearly in FIG. 12 of the drawings.

Figure 6:
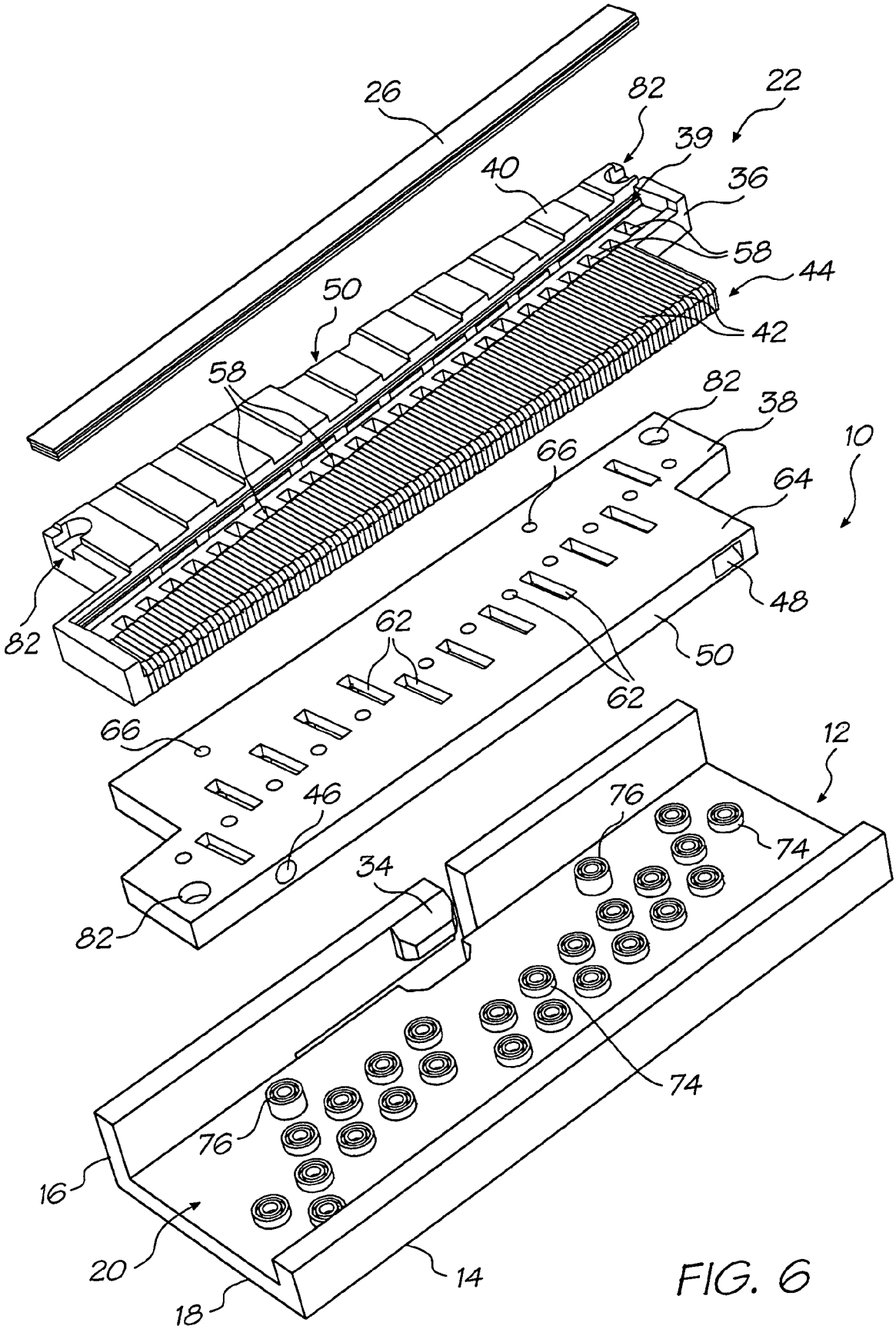
FIG. 6 shows a three dimensional, exploded view of the printhead of FIG. 5.
Figure 7:
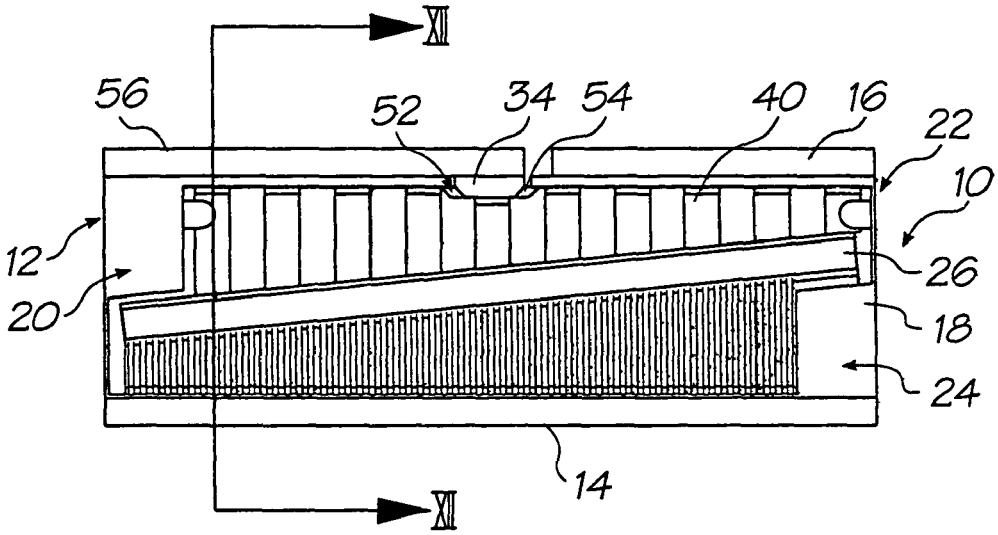
FIG. 7 shows a plan view of the printhead of FIG. 5.
Figure 8:
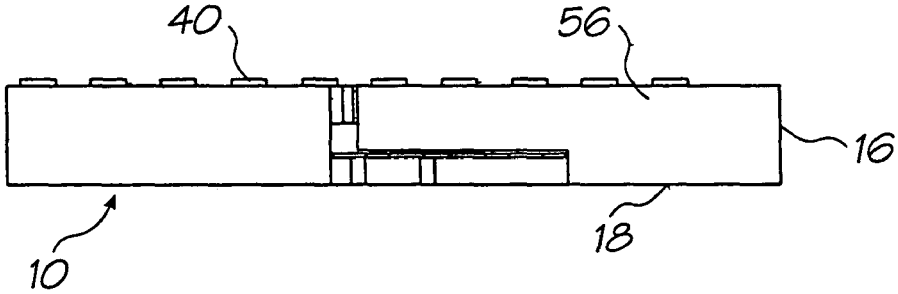
FIG. 8 shows a side view, from one side, of the printhead of FIG. 5.
Figure 9:
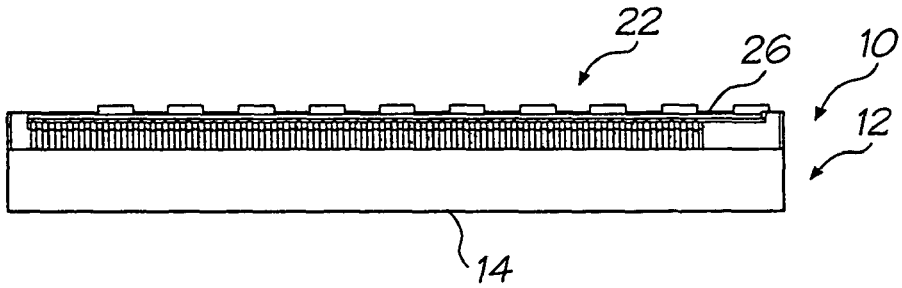
FIG. 9 shows a side view, from an opposed side, of the printhead of FIG. 5.
Figure 10:
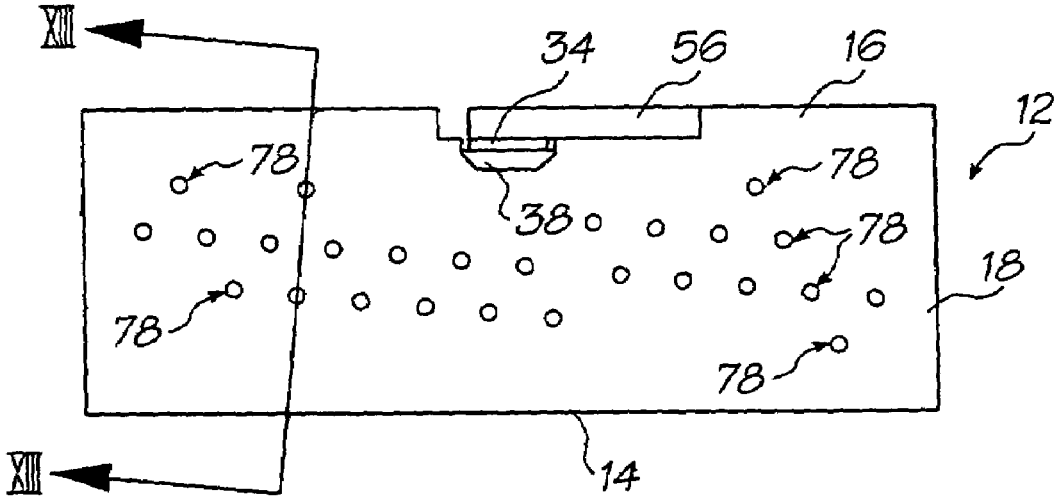
FIG. 10 shows a bottom view of the printhead of FIG. 5.
Figure 11:
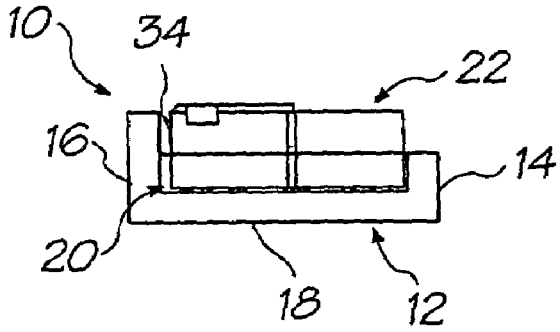
FIG. 11 shows an end view of the printhead of FIG. 5.

As shown most clearly in FIG. 6 of the drawings, each tile 22 includes a first molding 36 and a second molding 38 which mates with the first molding 36. The molding 36 has a longitudinally extending channel 39 in which the printhead chip 26 is received. In addition, on one side of the channel 39, a plurality of raised ribs 40 is defined for maintaining print media, passing over the printhead chip 26 at the desired spacing from the printhead chip 26. A plurality of conductive ribs 42 is defined on an opposed side of the channel 39. The conductive ribs 42 are molded to the molding 36 by hot stamping during the molding process. These ribs 42 are wired to electrical contacts of the chip 26 for making electrical contact with the chip 26 to control operation of the chip 26. In other words, the ribs 42 form a connector 44 for connecting control circuitry, as will be described in greater detail below, to the nozzles of the chip 26.

The locating formations of the tile 22 comprise a pair of longitudinally spaced co-operating elements in the form of receiving recesses 46 and 48 arranged along one side wall 50 of the second molding 38 of the tile 22. These recesses 46 and 48 are shown most clearly in FIG. 6 of the drawings.

The recesses 46 and 48 each receive one of the associated locating formations 32 therein.

The molding 36 of the tile 22 also defines a complementary element or recess 50 approximately midway along its length on a side of the molding 36 opposite the side having the recesses 46 and 48. When the molding 36 is attached to the molding 38 a stepped recess portion 52 (FIG. 7) is defined which receives the snap release 34 of the channel shaped member 12.

The locating formations 32 of the channel shaped member 12 are in the form of substantially hemispherical projections extending from the internal surface of the wall 14.

Figure 12:
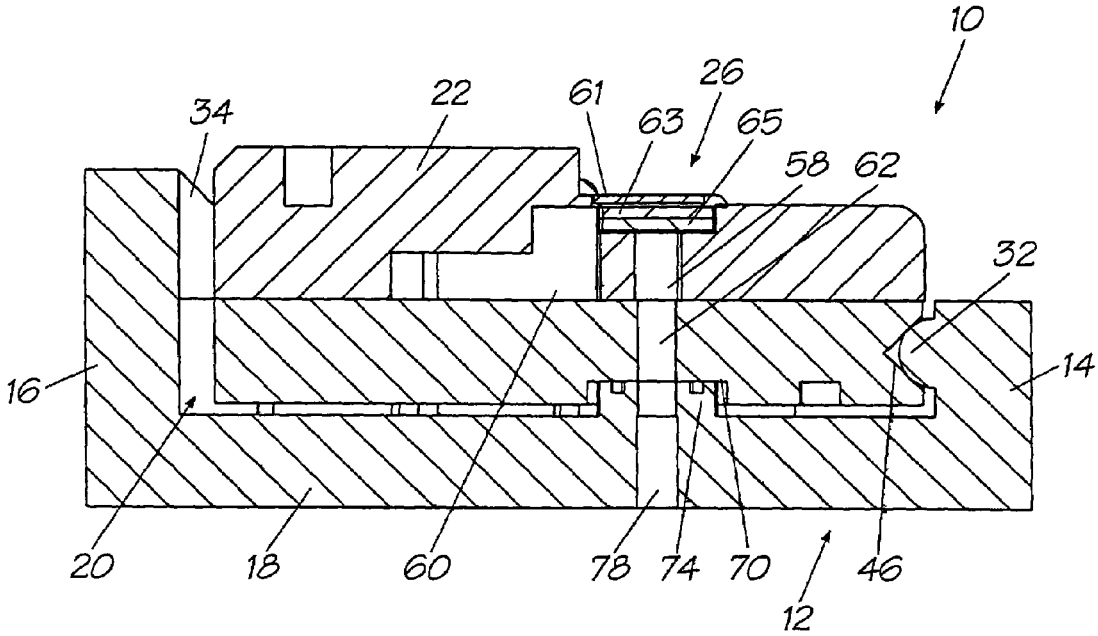
FIG. 12 shows a sectional end view of the printhead of FIG. 5 taken along line XII—XII in FIG. 7.
Figure 13:
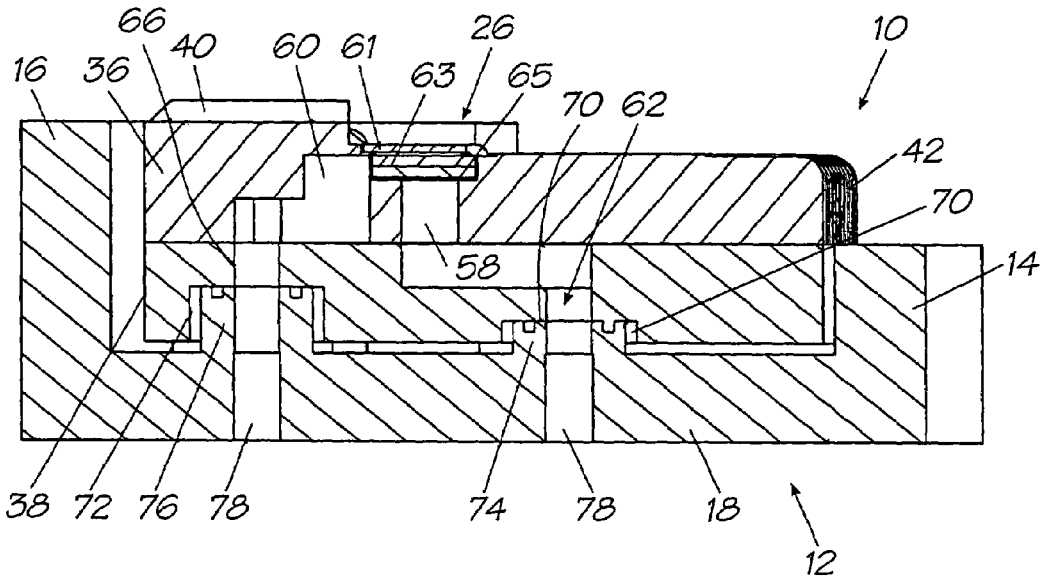
FIG. 13 shows a sectional end view of the printhead of FIG. 5 taken along line XIII—XIII in FIG. 10.

The recess 46 of the tile 22 is substantially conically shaped, as shown more clearly in FIG. 12 of the drawings. The recess 48 is elongate and has its longitudinal axis extending in a direction parallel to that of a longitudinal axis of the channel shaped member 12. Moreover, the formation 48 is substantially triangular, when viewed in cross section normal to its longitudinal axis, so that its associated locating formation 32 is slidably received therein.

When the tile 22 is inserted into its assigned position in the channel 20 of the channel shaped member 12, the locating formations 32 of the channel shaped member 12 are received in their associated receiving formations 46 and 48. The snap release 34 is received in the recess 50 of the tile 22 such that an inner end of the snap release 34 abuts against a wall 54 (FIG. 7) of the recess 50.

Also, it is to be noted that a width of the tile 22 is less than a spacing between the walls 14 and 16 of the channel shaped member 12. Consequently, when the tile 22 is inserted into its assigned position in the channel shaped member 12, the snap release 34 is moved out of the way to enable the tile 22 to be placed. The snap release 34 is then released and is received in the recess 50. When this occurs, the snap release 34 bears against the wall 54 of the recess 50 and urges the tile 22 towards the wall 14 such that the projections 32 are received in the recesses 46 and 48. The projection 32 received in the recess, locates the tile 22 in a longitudinal direction. However, to cater for an increase in length due to expansion of the tiles 22, in operation, the other projection 32 can slide in the slot shaped recess 48. Also, due to the fact that the snap release 34 is shorter than the recess 50, movement of that side of the tile 22 relative to the channel shaped member 12, in a longitudinal direction, is accommodated.

It is also to be noted that the snap release 34 is mounted on a resiliently flexible arm 56. This arm 56 allows movement of the snap release in a direction transverse to the longitudinal direction of the channel shaped member 12. Accordingly, lateral expansion of the tile 22 relative to the channel shaped member 12 is facilitated. Finally, due to the angled walls of the projections 46 and 48, a degree of vertical expansion of the tile 22 relative to the floor 18 of the channel shaped member 12 is also accommodated.

Hence, due to the presence of these mounting formations 32, 34, 46, 48 and 50, the alignment of the tiles 22, it being assumed that they will all expand at more or less the same rate, is facilitated.

Figure 14:
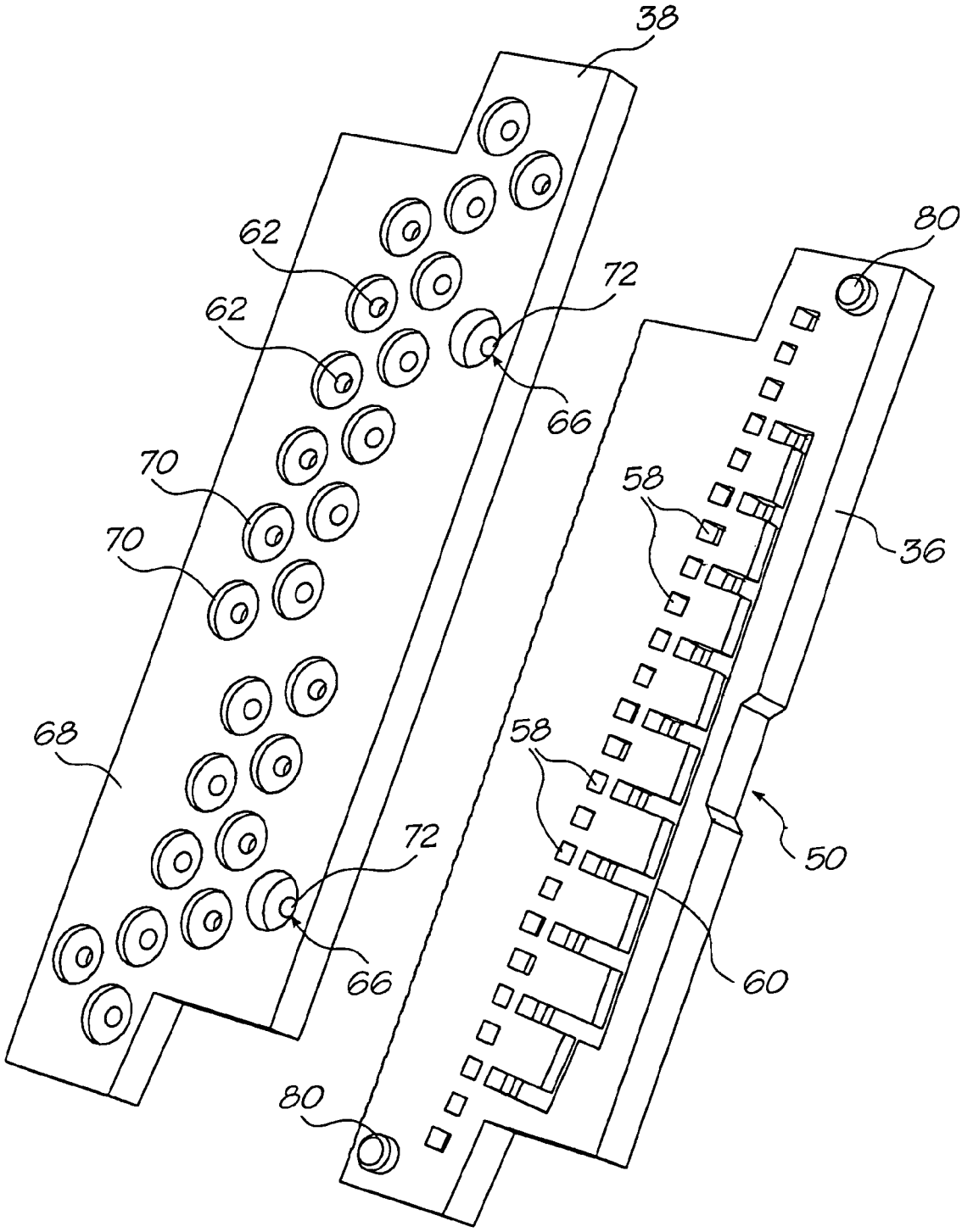
FIG. 14 shows a three dimensional, underside view of a printhead component.

As shown more clearly in FIG. 14 of the drawings, the molding 36 has a plurality of inlet openings 58 defined at longitudinally spaced intervals therein. An air supply gallery 60 is defined adjacent a line along which these openings 58 are arranged. The openings 58 are used to supply ink and related liquid materials such as fixative or varnish to the printhead chip 26 of the tile 22. The gallery 60 is used to supply air to the chip 26. In this regard, the chip 26 has a nozzle guard 61 (FIG. 12) covering a nozzle layer 63 of the chip 26. The nozzle layer 63 is mounted on a silicon inlet backing 65 as described in greater detail in our co-pending application number U.S. Ser. No. 09/608,779, entitled "An ink supply assembly for a print engine". The disclosure of this co-pending application is specifically incorporated herein by cross-reference.

The opening 58 communicates with corresponding openings 62 defined at longitudinally spaced intervals in that surface 64 of the molding 38 which mates with the molding 36. In addition, openings 66 are defined in the surface 64 which supply air to the air gallery 60.

As illustrated more clearly in FIG. 14 of the drawing, a lower surface 68 has a plurality of recesses 70 defined therein into which the openings 62 open out. In addition, two further recesses 72 are defined into which the openings 66 open out.

The recesses 70 are dimensioned to accommodate collars 74 standing proud of the floor 18 of the channel shaped member 12. These collars 74 are defined by two concentric annuli to accommodate movement of the tile 22 relative to the channel 20 of the channel shaped member 12 while still ensuring a tight seal. The recesses 66 receive similar collars 76 therein. These collars 76 are also in the form of two concentric annuli.

The collars 74, 76 circumscribe openings of passages 78 (FIG. 10) extending through the floor 18 of the channel shaped member 12.

The collars 74, 76 are of an elastomeric, hydrophobic material and are molded during the molding of the channel shaped member 12. The channel shaped member 12 is thus molded by a two shot molding process.

To locate the molding 38 with respect to the molding 36, the molding 36 has location pegs 80 (FIG. 14) arranged at opposed ends. The pegs 80 are received in sockets 82 (FIG. 6) in the molding 38.

In addition, an upper surface of the molding 36, i.e. that surface having the chip 26, has a pair of opposed recesses 82 which serve as robot pick-up points for picking and placing the tile 22.

Figure 15:
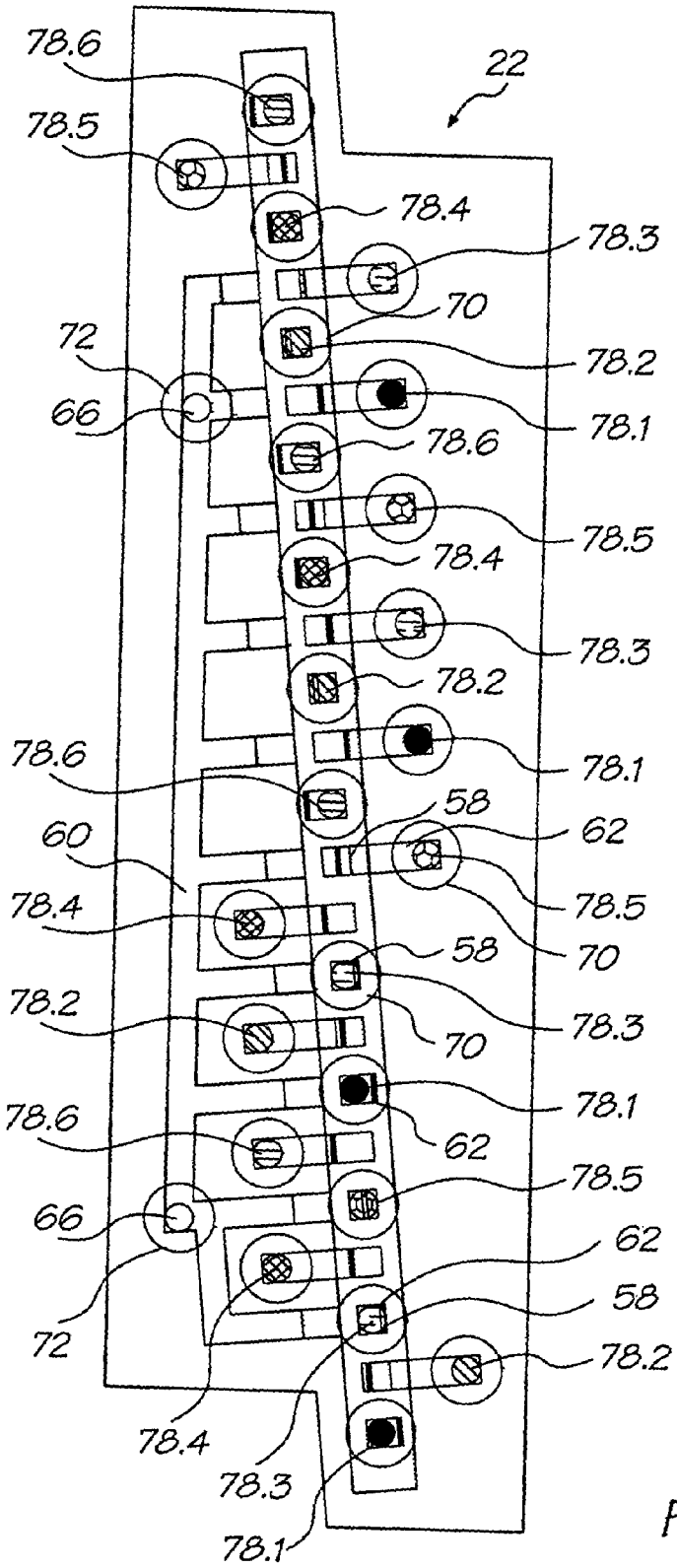
FIG. 15 shows a bottom view of the component, illustrating schematically the supply of fluid to a printhead chip of the component.

A schematic representation of ink and air supply to the chip 26 of the tile 22 is shown in greater detail in FIG. 15 of the drawings.

Thus, via a first series of passages 78.1 cyan ink is provided to the chip 26. Magenta ink is provided via passages 78.2, yellow ink is provided via passages 78.3, and black ink is provided via passages 78.4. An ink which is invisible in the visible spectrum but is visible in the infrared spectrum is provided by a series of passages 78.5 and a fixative is provided via a series of passages 78.6. Accordingly, the chip 26, as described, is a six "color" chip 26.

To cater for manufacturing variations in tolerances on the tile 22 and the channel shaped member 12, a sampling technique is used.

Upon completion of manufacture, each tile 22 is measured to assess its tolerances. The offset from specification of the particular tile 22 relative to a zero tolerance is recorded and the tile 22 is placed in a bin containing tiles 22 each having the same offset. A maximum tolerance of approximately +10 microns or −10 microns, to provide a 20 micron tolerance band, is estimated for the tiles 22.

The storage of the tiles 22 is determined by a central limit theorem which stipulates that the means of samples from a non-normally distributed population are normally distributed and, as a sample size gets larger, the means of samples drawn from a population of any distribution will approach the population parameter.

In other words, the central limit theorem, in contrast to normal statistical analysis, uses means as variates themselves. In so doing, a distribution of means as opposed to individual items of the population is established. This distribution of means will have its own mean as well its own variance and standard deviation.

The central limit theorem states that, regardless of the shape of the original distribution, a new distribution arising from means of samples from the original distribution will result in a substantially normal bell-shaped distribution curve as sample size increases.

In general, variants on both sides of the population mean should be equally represented in every sample. As a result, the sample means cluster around the population mean. Sample means close to zero should become more common as the tolerance increases regardless of the shape of the distribution which will result in a symmetrical uni-modal, normal distribution around the zero positions.

Accordingly, upon completion of manufacture, each tile 22 is optically measured for variation between the chip 26 and the moldings 36, 38. When the tile assembly has been measured, it is laser marked or bar coded to reflect the tolerance shift, for example, +3 microns. This tile 22 is then placed in a bin of +3 micron tiles.

Each channel 12 is optically checked and the positions of the locating formations 32, 34 noted. These formations may be out of alignment by various amounts for each tile location or bay. For example, these locating formations 32, 34 may be out of specification by −1 micron in the first tile bay, by +3 microns in the second tile bay, by −2 microns in the third tile bay, etc.

The tiles 22 will be robot picked and placed according to the offsets of the locating formations 32, 34. In addition, each tile 22 is also selected relative to its adjacent tile 22.

With this arrangement, variations in manufacturing tolerances of the tiles 22 and the channel shaped member 12 are accommodated such that a zero offset mean is possible by appropriate selections of tiles 22 for their locations or bays in the channel shaped member 12.

A similar operation can be performed when it is desired or required to replace one of the tiles 22.

Figure 16:
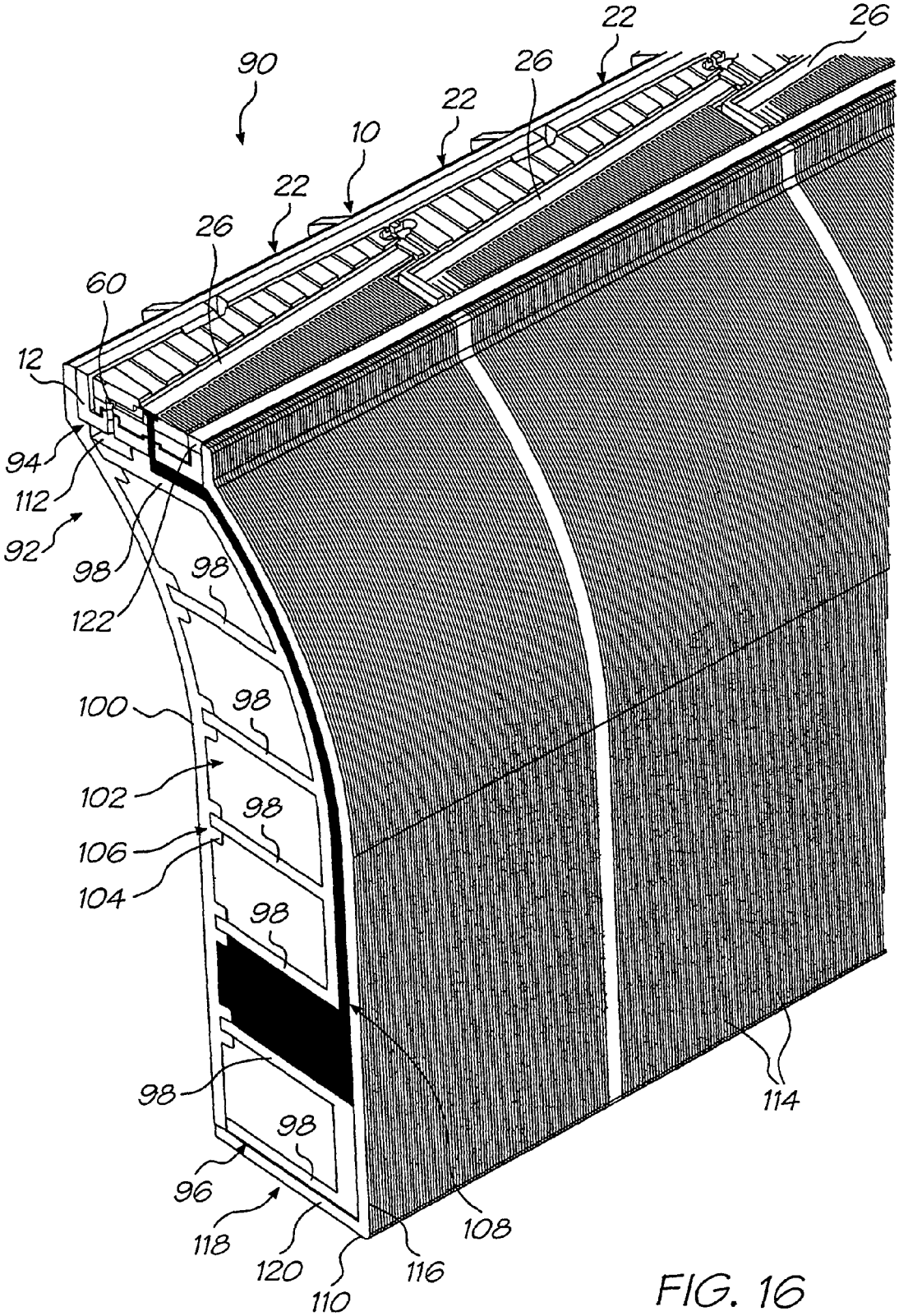
FIG. 16 shows a three dimensional, schematic view of a printhead assembly, including a printhead, in accordance with the invention.

Referring now to FIG. 16 of the drawings, a printhead assembly, also in accordance with the invention, is illustrated and is designated generally by the reference numeral 90. The assembly 90 includes a body member 92 defining a channel 94 in which the printhead 10 is receivable.

The body 92 comprises a core member 96. The core member 96 has a plurality of channel defining elements or plates 98 arranged in parallel spaced relationship. A closure member 100 mates with the core member 96 to close off channels defined between adjacent plates to form ink galleries 102. The closure member 100, on its operatively inner surface, has a plurality of raised rib-like formations 104 extending in spaced parallel relationship. Each rib-like member 104, apart from the uppermost one (i.e. that one closest to the channel 94) defines a slot 106 in which a free end of one of the plates 98 of the core member 96 is received to define the galleries 102.

A plurality of ink supply canals are defined in spaced parallel relationship along an operatively outer surface of the core member 96. These canals are closed off by a cover member 110 to define ink feed passages 108. These ink feed passages 108 open out into the channel 94 in communication with the passages 78 of the channel shaped member 12 of the printhead 10 for the supply of ink from the relevant galleries 102 to the printhead chip 26 of the tiles 22.

An air supply channel 112 is also defined beneath the channel 94 for communicating with the air supply gallery 60 of the tiles 22 for blowing air over the nozzle layer 63 of each printhead chip 26.

In a similar manner to the conductive ribs 42 of the tile 22, the cover member 110 of the body 92 carries conductive ribs 114 on its outer surface 116. The conductive ribs 114 are also formed by a hot stamping during the molding of the cover member 110. These conductive ribs 114 are in electrical contact with a contact pad (not shown) carried on an outer surface 118 of a foot portion 120 of the printhead assembly 90.

When the printhead 10 is inserted into the channel 94, the conductive ribs 42 of the connector 44 of each tile 22 are placed in electrical contact with a corresponding set of conductive ribs 114 of the body 92 by means of a conductive strip 122 which is placed between the connector 44 of each tile 22 and the sets of ribs 114 of the body 92. The strip 122 is an elastomeric strip having transversely arranged conductive paths (not shown) for placing each rib 42 in electrical communication with one of the conductive ribs 114 of the cover member 110.

Accordingly, it is an advantage of the invention that a printhead 10 is provided which is modular in nature, can be rapidly assembled by robotic techniques, and in respect of which manufacturing tolerances can be taken into account to facilitate high quality printing. In addition, a printhead assembly 90 is also able to be manufactured at high speed and low cost.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A printhead for a pagewidth ink jet printer, the printhead comprising:

an elongate receiving member that defines a receptacle; and at least one elongate printhead module, the at least one printhead module defining a channel in which a printhead chip is receivable, the receiving member and the at least one printhead module, together defining pairs of complementary location formations such that the at least one printhead module is received in the receptacle so that the complementary locating formations engage each other, with the at least one module extending along a longitudinal axis of the receiving member, wherein, for the at least one printhead module, the complementary location formations comprise a first pair of complementary location formations, the first pair comprising a projection and a recess adapted to receive the projection, wherein the recess is extended in the longitudinal direction with respect to the projection and wherein the projection is slidably received within the recess so that expansion of the at least one printhead module relative to the receiving member along the longitudinal axis is accommodated.

2. The printhead of claim 1 in which the receiving member has opposed walls interconnected by a bridging portion to define the receptacle.

3. The printhead of claim 2 which includes a plurality of printhead modules arranged in end-to-end relationship in the receptacle, each channel being angled with respect to its associated module so that the printhead chips of adjacent modules overlap.

4. The printhead of claim 3 in which each module is stepped at its end to nest with a consecutive module.

5. The printhead of claim 3 in which each printhead module has a set of locating formations and in which the receiving member has a complementary set of locating formations at a location for each module in the receptacle.

6. The printhead of claim 1 in which the recess is a slot, and the projection is hemispherical.

7. The printhead of claim 1 in which, for the at least one printhead module, the complementary location formations further comprises a second pair of complementary location formations comprising a projection and a correspondingly sized recess for receiving the projection to locate the printhead module in a longitudinal direction within the receiving member.

8. The printhead of claim 7 in which the recesses of the first and second pair of complementary location formations are formed in a first wall of the at least one printhead module, and the projections of the first and second pair of complementary location formations are formed in a first wall of the receiving member.

9. The printhead of claim 8 wherein the recesses of the first and second pair of complementary location formations are substantially triangular, when viewed in cross section normal to the longitudinal axis.

10. The printhead of claim 8 in which, for the at least one printhead module, the complementary location formations further comprises a third pair of complementary location formations comprising a projection and a recess, the third formation of the receiving member being formed in a second wall of the receiving member opposite the first wall, the third formation of the at least one printhead module being formed in a second wall of the printhead module.

11. The printhead of claim 10 in which the third pair of complementary formations comprises a snap release extending from the second wall of the receiving member and a third recess formed in the at least one printhead module, wherein the snap release is received in the third recess such that an inner end of the snap release abuts against a wall of the third recess.

12. The printhead of claim 11 in which the width of the at least one printhead module is less than a spacing between the first and second opposed walls of the receiving member, and for the at least one printhead module, the snap release urges the at least one printhead module towards the first wall of the receiving member such that the projections of the first and second complementary location formations are received in the respective recesses of the first and second complementary location formations.

13. The printhead of claim 12 in which the snap release is mounted on a resiliently flexible arm of the second wall of the receiving member.

14. The printhead of claim 11 in which the length of the snap release in the longitudinal direction is shorter than the length of the third recess.

* * * * *